US005355289A

United States Patent [19]

Krenn

[11] Patent Number: 5,355,289

[45] Date of Patent: Oct. 11, 1994

[54] LIGHTED SERVING TRAY

[76] Inventor: Ronald J. Krenn, 142 Reef Rd., South Daytona, Fla. 32119

[21] Appl. No.: 100,285

[22] Filed: Aug. 2, 1993

[51] Int. Cl.[5] ..... F21V 33/00

[52] U.S. Cl. ..... 362/253; 362/800; 362/184; 362/154; 362/252

[58] Field of Search ..... 362/253, 800, 806, 154, 362/244, 252, 184, 191, 249

[56] References Cited

U.S. PATENT DOCUMENTS

| | | | |
|---|---|---|---|
| 3,321,616 | 5/1967 | Adler | 362/31 |
| 3,808,415 | 4/1974 | Hurst | 362/31 |
| 3,892,959 | 7/1975 | Pulles | 362/31 |
| 4,085,541 | 4/1978 | Mapp | 362/184 |
| 4,446,508 | 5/1984 | Kinzie | 362/31 |
| 4,521,839 | 6/1985 | Cook et al. | 362/249 |
| 4,626,971 | 12/1986 | Schultz | 362/154 |
| 4,803,604 | 2/1989 | Nichols et al. | 362/800 |
| 5,131,066 | 7/1992 | Foss | 385/135 |

*Primary Examiner*—Ira S. Lazarus
*Assistant Examiner*—Sara Sachie Raab
*Attorney, Agent, or Firm*—William M. Hobby, III

[57] ABSTRACT

A lighted serving tray includes a tray portion having a flat bottom surface, a perimeter rim, and a hollow transparent tube attached to the tray adjacent to the perimeter rim. A plurality of lights are attached in the transparent tube in a spaced relationship to each other and a battery is connected through an electrical conductor to each of the lights through a switch. A flashing circuit can be connected in the circuit. The lights can be LED's and the hollow tube can be detached to form a circle around the circular tray so that the lighted tray is visible within an area of low light when being carried by a waitress or the like.

5 Claims, 1 Drawing Sheet

LIGHTED SERVING TRAY

BACKGROUND OF THE INVENTION

The present invention relates to a lighted serving tray and especially to a transparent tube mounted to the rim of a tray and having a plurality of lamps mounted inside the tube.

In the past, it has been common to provide a wide variety of serving trays which typically are circular with a flat bottom and a perimeter rim. This type of serving tray is carried by a waitress or other person serving drinks, hors d'oeuvres or the like. Frequently, the tray is utilized in areas of low light, such as in restaurants, private parties, bars, making it difficult for a patron to locate the waitress or to obtain service. The present invention provides for a tray having lights such as LED's, mounted within a transparent tube and is not shorted by the spillage of liquid from glasses or bottles on the tray. When a server is using the tray in a low light situation, they can turn on a switch to light up the lights so that patrons can readily locate a server to obtain service.

U.S. patents considered of interest to the present invention includes the Schultz U.S. Pat. No. 4,626,971, which shows an illuminates surgical tray for use by surgeons in viewing surgical materials. The Kinzie U.S. Pat. No. 4,446,508, shows an edge lighted article holder and specifically is directed towards a cup or glass holder which is edge lighted so that the articles being supported can be more readily viewed and identified. The Hurst U.S. Pat. No. 3,808,415, as well as the Pulles U.S. Pat. No. 3,892,959, and the Adler U.S. Pat. No. 3,321,616, all show lighted surfaces for supporting reading materials or other objects for use in better identification. U.S. Pat. No. 5,131,066 to Foss shows an optical fiber tray arrangement. None of the prior patents mentioned, however, deal with locating a waitress or other server by lighting the tray so as to be visible to others and which protects the lamps from damage during cleaning of the tray and from spilled liquid from containers carried on the tray.

SUMMARY OF THE INVENTION

A lighted serving tray includes a tray portion having a flat bottom surface and a perimeter rim and a hollow transparent or translucent tube attached to the tray adjacent to the perimeter rim. A plurality of lights are attached in the transparent tube in a spaced relationship to each other and a battery is connected through an electrical conductor to each of the lights through an electrical switch. The lights can be LED's and the hollow tube can be attached to form a circle around the circular tray. The lighted tray is visible within an area of low light when being carried by a waitress or the like.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
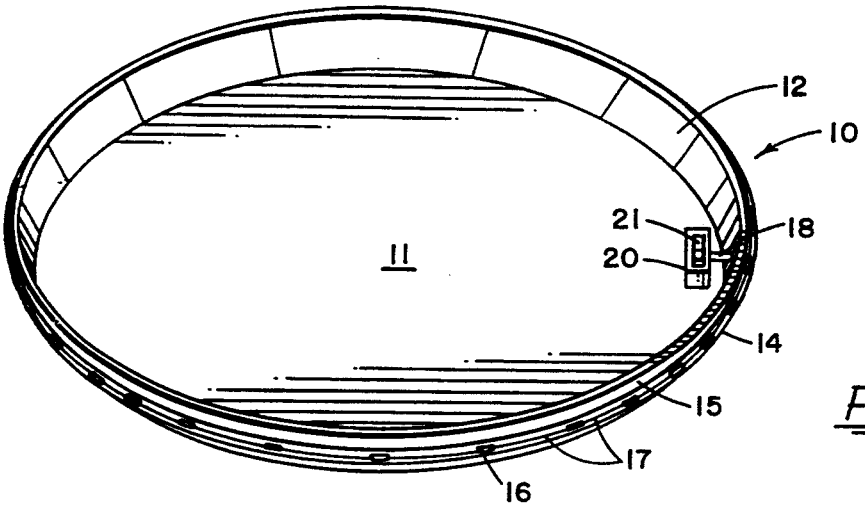
FIG. 1 is a perspective view of a lighted serving tray in accordance with the present invention.
Figure 2:
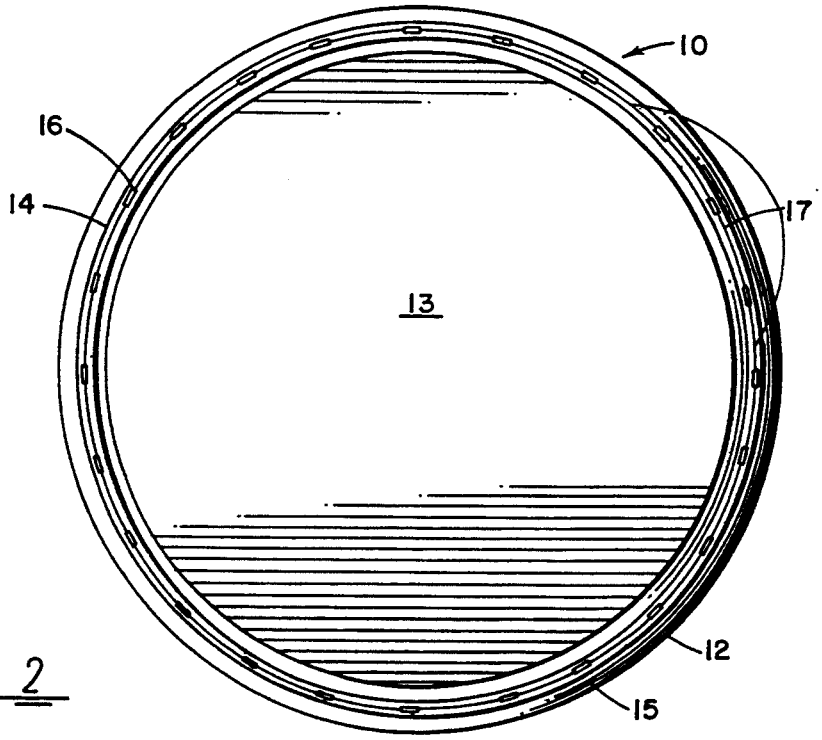
FIG. 2 is a bottom plan view of the serving tray in accordance with FIG. 1.
Figure 3:
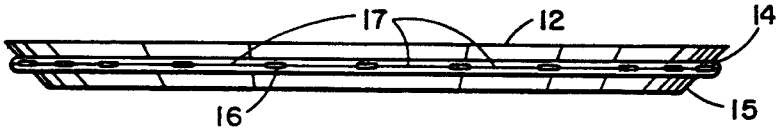
FIG. 3 is a side elevation of the tray in accordance with FIGS. 1 and 2.

Referring to FIGS. 1–3 of the drawings, a serving tray 10 is illustrated having a flat bottom 11 with an encircling rim 12 of the type used by waitresses and servers for serving drinks or food items and which is supported beneath the tray on the bottom flat surface 13. The rim 12 is not only circular and angles away from the surface 11 and has a transparent tube, such as a transparent or translucent polymer tube, encircling the tray 10 and fixedly attached to the outer rim 15 to form a complete circle with the polymer tubing. The polymer tubing is filled with spaced lamps 16 which may be light emitting diodes or LED's which are interconnected with fine wire conductors 17 connecting all of the items, either in series or parallel, which conductor extends through the rim 12 and through a conduit 18 connected to the battery pack 20 which includes a built-in switch 21 which switches the in-line conductor between the batteries in the battery pack 20 and the conductors line 17 to turn the lamp 16 on and off. The battery pack 20 might also include a commonly available flashing circuit for simultaneously flashing all of the lamps 16.

Thus, a server using the tray 10 can have a plurality of glasses filled with drinks thereon for service to patrons. The tray is supporting from the bottom 13. The server can then switch on the switch 21 which connects the battery in the battery pack 20 dc current to the lamps or LED's 16 through the conductor 17 to thereupon light up all of the lamps 16 simultaneously and draw attention to the server. Any one looking for a drink or service can quickly spot the server in a lowly lit room in order to be able to obtain a drink or food carried by the server.

A flashing circuit may be built into the battery pack 20. All of the lamps 16 would then flash continuously to draw attention to the tray since the tubing 14 extends all the way around the rim 12 of the tray on the outside thereof and is connected to form a continuous loop. All of the lamps 16 as well as the conductors are protected from spills of liquids. In addition, the polymer tube 14, which may be a vinyl tube, will cushion and prevent lamps 16 from being broken by the tray bumping into surfaces and during cleaning. The polymer tubing 14 can be attached to the outer rim 15 with an adhesive to simplify the production of the lighted tray. The tray itself can be made of stainless steel or aluminum or it can be made of a polymer or may be a coated steel material without departing from the spirit and scope of the invention.

It should be clear at this point that an illuminated serving tray has been provided which allows patrons to quickly spot a server in places of low light, such as in private parties, restaurants with low light or candle light eating, and in conventional bars and cocktail lounges. However, the present invention is not to be construed as limited to the forms shown which is to be considered illustrative rather than restrictive.

I claim:

1. A serving tray easily spotted by a patrol in low light comprising:

a tray having a flat bottom surface and a perimeter flange;

a flexible hollow transparent round polymer tube attached to said perimeter flange;

a plurality of lights attached in said transparent tube in a spaced relationship to each other;

an electric battery housing attached to said tray bottom and having a battery therein;

an electric conductor connecting each of said plurality of lights to said electric battery, whereby a lighted tray is visible within an area of low light without distracting the person holding the tray; and said tray perimeter flange being angled outward from said tray flat bottom and said hollow transparent tube being mounted to said perimeter flange around the exterior thereof and below the edge of the perimeter flange whereby said perimeter flange shields the transparent tube and the lights mounted therein from a person holding the tray.

2. A serving tray in accordance with claim 1 including an electric switch attached to said electric conductor between said electric power source and said plurality of lights.

3. A lighted serving tray in accordance with claim 1 in which said plurality of lights includes a plurality of light emitting diodes.

4. A serving tray in accordance with claim 1 in which a light flashing circuit is connected into said electrical conductor to thereby flash said lights in said hollow transparent tube.

5. A lighted serving tray in accordance with claim 1 in which said perimeter flange is circular.

* * * * *